United States Patent [19]

Seiler et al.

[11] Patent Number: 5,025,249

[45] Date of Patent: Jun. 18, 1991

[54] PIXEL LOOKUP IN MULTIPLE VARIABLY-SIZED HARDWARE VIRTUAL COLORMAPS IN A COMPUTER VIDEO GRAPHICS SYSTEM

[75] Inventors: Larry D. Seiler, Boylston; James L. Pappas, Leominster; Robert C. Rose, Hudson, all of Mass.

[73] Assignee: Digital Equipment Corporation, Hudson, Mass.

[21] Appl. No.: 206,026

[22] Filed: Jun. 13, 1988

[51] Int. Cl.[5] ..... G09G 1/00

[52] U.S. Cl. ..... 340/721; 340/723; 340/729; 340/734; 340/522; 364/522

[58] Field of Search ..... 340/720, 721, 723, 729, 340/734, 742, 701, 703; 364/521, 522

[56] References Cited

U.S. PATENT DOCUMENTS

| | | | |
|---|---|---|---|
| 4,204,206 | 5/1980 | Bakula et al. | 340/721 |
| 4,386,410 | 5/1983 | Pandya et al. | 364/518 |
| 4,412,294 | 10/1983 | Watts et al. | 364/518 |
| 4,484,187 | 11/1984 | Brown et al. | 340/721 |
| 4,542,376 | 9/1985 | Bass et al. | 340/724 |
| 4,545,070 | 10/1985 | Miyagawa et al. | 340/723 |
| 4,550,315 | 10/1985 | Bass et al. | 340/703 |
| 4,642,790 | 2/1987 | Minshull et al. | 340/723 |
| 4,694,288 | 9/1987 | Harada | 340/721 |
| 4,700,320 | 10/1987 | Kapur | 364/521 |
| 4,710,761 | 12/1987 | Kapur et al. | 340/721 |
| 4,710,767 | 12/1988 | Sciacero et al. | 340/799 |
| 4,727,425 | 2/1988 | Mayne et al. | 358/80 |
| 4,752,893 | 5/1988 | Guttag et al. | 364/518 |
| 4,772,881 | 9/1988 | Hannah | 340/703 |

*Primary Examiner*—Donald J. Yusko
*Assistant Examiner*—John Giust
*Attorney, Agent, or Firm*—Arnold, White & Durkee

[57] ABSTRACT

This invention adds a window dependent base value to the pixel values read from a frame buffer or other source of pixel values. The base value points to the base of the colormap for that window, which is allocated within a larger, physical colormap. Each window can access physical colormap entries starting at its base value and extending up to the base value plus the maximum pixel value used in that window. Adding a window dependent base value to the pixel values for each window allows different windows to use different colormaps, each of which can be allocated to any contiguous set of entries in the physical colormap. Each window's virtual colormap need only use as many entries in the physical colormap as there are entries in the virtual colormap. Finally, virtual colormaps can be compacted or otherwise reallocated in the physical colormap without requiring changes in the pixel values stored in the frame buffer. Only the colormap base values stored for each window need be changed.

11 Claims, 5 Drawing Sheets

PIXEL LOOKUP IN MULTIPLE VARIABLY-SIZED HARDWARE VIRTUAL COLORMAPS IN A COMPUTER VIDEO GRAPHICS SYSTEM

RELATED APPLICATIONS

This invention is related to the following applications, all of which are assigned to the assignee of the present invention and concurrently filed herewith in the names of the inventors of the present invention:

- Semaphore Controlled Video Chip Loading in a Computer Video Graphics System, Ser. No. 206,203.
- Datapath Chip Test Architecture, Ser. No. 206,194, now Pat. No. 4,929,889.
- Window Dependent Pixel Datatypes in a Computer Video Graphics System, Ser. No. 206,031.
- Apparatus and Method For Specifying Windows With Priority Ordered Rectangles in a Computer Video Graphics System, 206,030, now abandoned.

BACKGROUND OF THE INVENTION

This invention relates generally to the field video display systems. More particularly, this invention relates to a computer video graphics system capable of displaying multiple windows each having a selectively assigned virtual colormap within one physical color lookup table.

In computer video graphics systems, a monitor displays frames of information provided by a frame buffer many times a second. The subsystem of a video graphics system between the frame buffer and the monitor is called the video datapath. As the format and content of video data become increasingly complex, the capability of video displays increases. For example, providing the feature of windows in graphics systems increases the demand on and complexity of the video datapath. Large volumes of digital data in the form of state information are called for to define window boundaries and other window attributes or characteristics. Further, pixel values in a frame buffer or provided from some other source are manipulated in graphics display systems in order to display proper colors on a graphics monitor. Color lookup tables (colormaps) are commonly used to provide color values to a digital to analog converter (DAC) to be displayed on the monitor.

Graphics terminals, as opposed to graphics workstations, are designed to be controlled by a single application at a time. Graphics terminals have only one colormap, which is controlled by the same application that controls the screen.

A multi-window graphics workstation allocates portions of this screen among multiple applications. Window systems allow graphics workstations to display data from multiple applications at the same time. Each window may have different purposes that require using a different set of colors. If specific planes of the frame buffer directly control the DAC or DACs that drive the monitor, then there is no colormap and the problem of allocating control of the colormap is avoided.

Virtual colormaps allow multiple windows to use independent sets of colors. Displaying from multiple colormaps simultaneously requires some means to select among multiple colormaps based on the window containing each pixel.

Multi-window graphics workstations that have colormaps must address the problem of allocating control of the colormap. Early known graphics systems simply gave the entire colormap to some one window, causing other windows to display in false colors. Other known graphics systems solved this problem in a limited way by putting fixed values into 16 colormap entries and allowing a single application to control the rest of a 256 entry colormap. Applications that needed only a few colors out of a limited range could use the fixed colors as some other applications used the rest of the colormap. Applications that needed all 256 colors could perform a special request to get the entire colormap. This is not a virtual colormap because it is limited to a predefined set of colors plus one application colormap.

Most known workstations support only a single colormap. Windows that use different sets of colors can only be displayed correctly one at a time. Some workstations provide multiple colormaps. This is generally in the form of multiple separate physical colormaps, with some form of bank selection to choose which colormap to use at each pixel. In general, this is done using extra planes in the frame buffer.

Virtual colormaps can be implemented in software. This involves packing together multiple colormaps requested by multiple windows into a single hardware colormap as indexed by the frame buffer, and then altering drawing operations to the frame buffer so that high order bit planes are set as needed to make each window index the correct part of the single physical colormap. The pixel values written into the frame buffer are modified to reference the desired portion of the physical colormap. However, this approach has several problems, the most important of which is the need to restrict colormaps to powers of two in size and to allocate them on similar powers of two boundaries. That is necessary to restrict the changes in the frame buffer pixel values to unused high order bits. Some applications depend on the relationship between different pixel values. Because of this, the bits of each pixel that are used to look up the color within a virtual colormap must not be changed.

A key problem in color, multi-window workstations is how to allow different windows, possibly controlled by different processes running totally different applications, to use the same physical colormap. Many advanced graphics applications require the ability to specify their own sets of colors. If all other windows disappear or are displayed in false colors when using these applications, then the workstation has in effect become a single window workstation. Worse, system colors used for the screen background and window borders may become indistinguishable when running these advanced applications, so that the user interface becomes very difficult to use.

It would be advantageous to have a simple and efficient implementation of virtual colormaps. This would allow multiple windows to easily be displayed in their proper colors, even though each could use a different set of colors. Since multiple colormaps would be packed efficiently, the largest possible number of virtual colormaps could be loaded at once, given the size of the physical colormap, so that as many windows as possible could be displayed in their proper colors.

It is also desirable to have multiple colormaps that are associated with different windows on the screen to be allocated and deallocated as a virtual resource, without requiring changes to the pixel values in the frame buffer.

It is desirable that the virtual colormaps required by different windows be of different sizes. With virtual colormaps of different sizes, a means is required for efficiently packing them into the physical colormap, with as little wasted space as possible. More importantly, the allocation process must be simple, to reduce the effort needed to write system software that manages the colormap. Reallocation of virtual colormaps must also be fast, so that changing the set of allocated colormaps does not significantly reduce system performance.

It is also desirable that multiple virtual colormaps be combined into a single physical colormap by appending them to each other. If this were so, there would be no alignment restrictions on where a virtual colormap may start within the physical colormap, and no restrictions on the lengths of individual virtual colormaps. The physical colormap may be treated as a linear address space of pixel-to-color translations, and each virtual colormap could use any contiguous set of entries in it.

With such an arrangement it would be simple to allocate colormaps with minimal wasted space. Finally, reallocating colormaps would require changes only in a table of base values and the colormap entries themselves. Since the pixel values in the frame buffer would not have to be changed, colormap reallocation would be fast.

SUMMARY OF THE INVENTION

The present invention is generally directed to solving the foregoing and other problems, as well as satisfying the recited shortcomings of known computer graphics systems.

In the present invention, pixel data is processed from the frame buffer according to a specified pixel data type for each window. The pixel value produced as a result of this processing is then converted into an index into the physical colormap. This is done by adding a base value to the pixel value. The base value is selected based on the window containing this pixel. The pixel value is therefore a relative index into a window's virtual colormap, which is pointed to by the base value. This base/-displacement style of colormap indexing is used to index a pixel value into a specified virtual colormap.

This invention specifies a base colormap index for each window, which is added to the pixel values in that window. This allows different windows to use different sets of entries within the physical colormap, with no constraints on where each set of entries starts or how large it is.

Using this invention, reallocation of colormaps has little effect on the performance of the display subsystem. In particular, pixel values in the frame buffer need not be changed as the colormap allocation changes. The only noticeable effect due to colormap reallocation is the unavoidable one that only windows whose colormaps are currently allocated are displayed in their proper colors.

This invention solves the colormap problem by providing hardware support for virtual colormaps. Each window draws pixel values into the frame buffer assuming the use of its own colormap. Logic in the video data path maps the pixel values from each window into references to their own separate piece of the physical colormap. As a result, multiple windows can display from their own independent color spaces at the same time.

If more virtual colormaps are used by windows on the screen than can be allocated in the physical colormap, then a priority algorithm must be invoked to determine which virtual colormaps to load. This allocation process can be carried on without affecting the process of drawing into the windows. Windows that do not have their colormaps loaded can continue to draw their pixels in the same fashion as before, and will display correctly when their colormaps are loaded. Windows whose colormaps are moved in the physical colormap need not alter the pixel values in the frame buffer, but can continue drawing without pause.

Virtual colormaps provide the vital function of allowing these different windows to use different colormaps. Virtual colormaps allow workstations to allocate the physical colormap among multiple windows. This allocation is transparent to the applications controlling the windows and requires no changes in the values written into the frame buffer.

Virtual colormaps allow windows to define colors that correspond to a range of virtual pixel values and then use those virtual pixel values to draw into the frame buffer, without concern over where or whether its desired colors are loaded into the physical colormap. Allocation of the physical colormap is carried out transparently to the graphics drawing process. A particular window may not always have its colormap loaded, but it can be loaded again when the window becomes the focus of attention.

This invention eliminates the need for altering the values drawn into the frame buffer based on the colormap allocation. Instead, the drawing process draws its pixels into the frame buffer, using the frame buffer planes in any way it chooses, and the display hardware uses knowledge of the regions covered by windows on the screen to select the proper colormap for each window.

This invention processes pixels read from the frame buffer in order to make each of them an index into the colormap specified for its window. Two things are required: a means for knowing the window that contains each pixel, and a means for selecting one of several different colormaps. Many solutions are possible for each of these subgoals. One solution uses a priority ordered list of rectangles to specify the window that owns each pixel. In this implementation, up to 64 different windows that use different colormaps can be distinguished. Other portions of the video data path may select between colormaps using a base/displacement calculation. The pixel value is treated as a displacement from a specified base address in the physical colormap.

One other requirement for hardware virtual colormaps is that the physical colormap must be larger than the largest colormap that a typical application will use. Otherwise, only one virtual colormap could be loaded at a time, and the advantages of virtual colormaps would be lost.

This invention allows multiple windows to each use their own colormaps, which define their mapping of pixel values to colors on the display screen. In particular, this mapping is performed in hardware in the video datapath, so that the pixel values stored in the frame buffer need not be changed as virtual colormaps are allocated and moved in the physical colormap.

Doing this virtual-to-physical mapping in hardware has several important advantages. First, it allows colormaps to be reallocated without the performance penalty of having to alter the pixel values in the frame buffer. Second, it allows colormap allocation to be performed asynchronously to drawing operations. Drawing operations can be partially completed when a colormap reallocation is performed, since the drawing operations are not affected. If this were not the case, either the drawing pipe would have to be flushed for each colormap allocation, or visible artifacts would appear on the screen, due to the pixel values being drawn and the location of the window's colormap being changed at different times.

BRIEF DESCRIPTION OF THE DRAWINGS

The above-noted and other aspects of the present invention will become more apparent from a description of the preferred embodiment when read in conjunction with the accompanying drawings.

The drawings illustrate the preferred embodiment of the invention, wherein like members bear like reference numerals and wherein.

DESCRIPTION OF A PREFERRED EMBODIMENT

Figure 1:
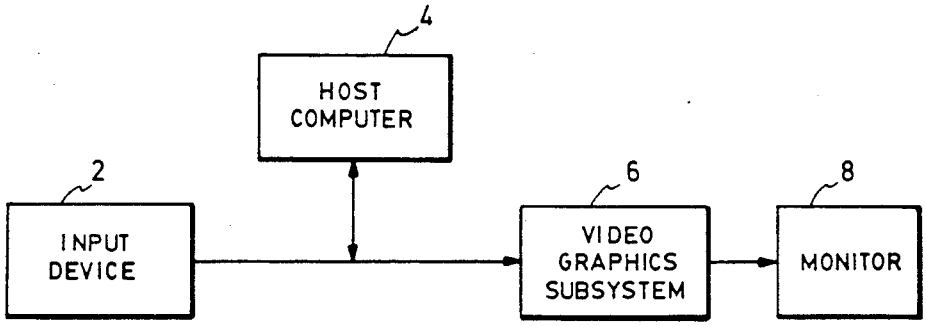
FIG. 1 is a general block diagram of a computer video graphics system employing the invention.

Referring to FIG. 1, a general block diagram of a video graphics system which employs the present invention is shown. An input device 2 functions as the means by which a user communicates with the system, such as a keyboard, a mouse or other input device. A general purpose host computer 4 is coupled to the input device 2 and serves as the main data processing unit of the system. In a preferred embodiment, the host computer 4 employs VAX architecture, as presently sold by the assignee of the present invention. A video graphics subsystem 6 receives data and graphics commands from the host computer 4 and processes that data into a form displayable by a monitor 8. The video graphics subsystem 6 features the use of large volume state tables for storing state data. According to the invention, the video graphics subsystem 6 is specially adapted to provide for multiple windows, each of which can be displayed in its own selected color. In a preferred embodiment, the monitor 8 is an RGB CRT monitor.

Figure 2:
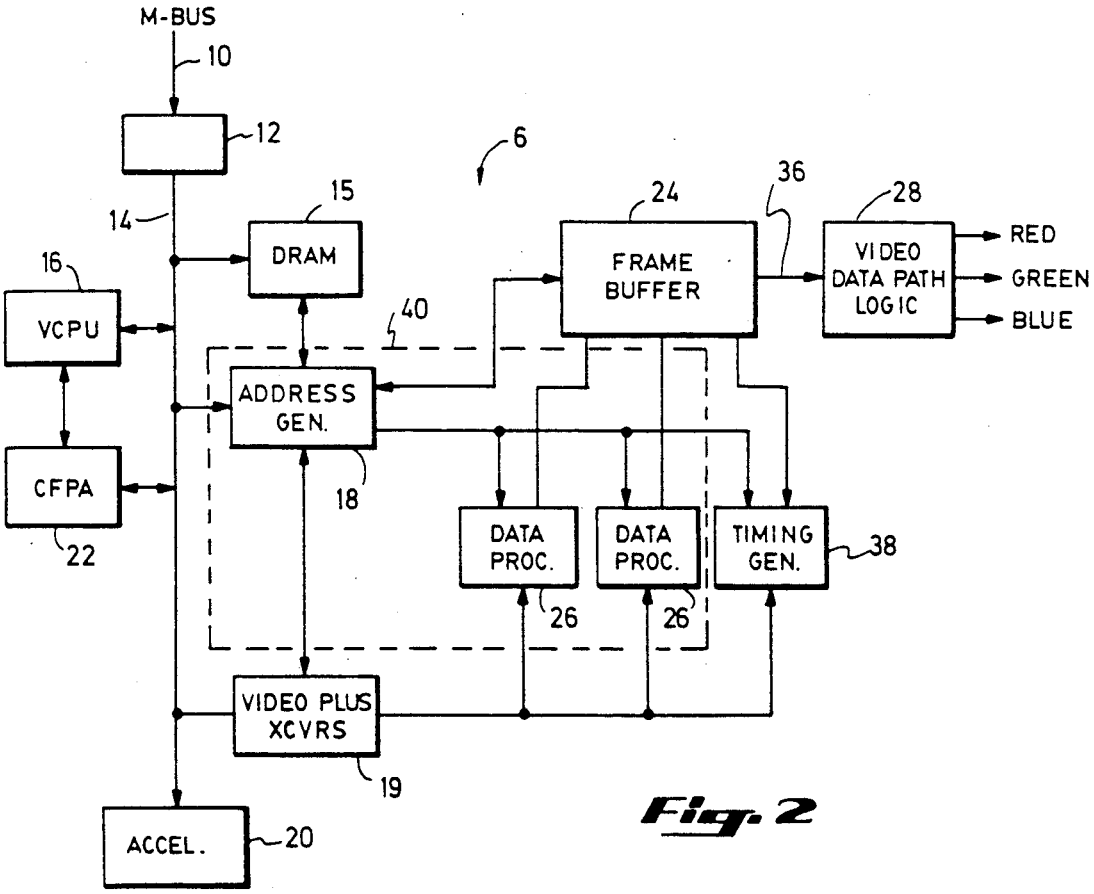
FIG. 2 is a block diagram of a system employing the present invention.

Referring now to FIG. 2, an embodiment of a video graphics subsystem 6 which employs the present invention is shown. This graphics subsystem is an interactive video generator which may be used for two-dimensional (2D) and three-dimensional (3D) graphics applications.

The graphics subsystem 6 receives graphics commands and data from the host Central Processing Unit (CPU) in the host computer 4 by way of a memory bus (M-Bus) 10. The host CPU communicates with a video graphics subsystem bus (VI-Bus) 14 by way of an interface 12. The interface 12 performs all functions necessary for synchronous communication between the M-Bus 10 of the host CPU and the VI-Bus 14 of the graphics subsystem 6. The interface 12 is of conventional design and decodes single transfer I/O read and write cycles from the M-Bus and translates them into VI-Bus cycles for the graphics subsystem in a manner known in the art. The interface 12 also supports Direct Memory Access (DMA) transfers over the M-Bus 10 between the workstation main memory in the host computer 4 and a video graphics system dynamic random access memroy (DRAM) 15. DMA transfer is a technique known in the art whereby a block of data, rather than an individual word or byte, may be transferred from one memory to another.

A graphics subsystem CPU (VCPU) 16 is provided as the main processing unit of the video graphics subsystem 6. All requests by the host CPU for access to the graphics subsystem (via the M-Bus 10/interface 12) go through an address generator 18 which serves as the arbitrator for the VI-Bus 14. There are three possible masters seeking access to the VI-Bus 14: the VCPU 16, the interface 12 and an accelerator 20. The address generator 18 grants bus mastership on a tightly coupled, fixed priority basis. The VCPU 16 is the default bus master. The accelerator 20 serves as a coprocessor with the VCPU 16.

The VCPU 16 also employs a floating point unit (CFPA) 22. The VCPU 16/CFPA 22 form the main controller of the graphics subsystem 6. This combination loads all graphics data to the graphics subsystem, provides memory management, an instruction memory, and downloads the initial code store of the accelerator 20.

As used herein, the term graphics rendering is understood to mean the process of interpreting graphics commands and data received from the host CPU 4 and generating resultant pixel data. The resultant pixel data is stored in so called on-screen memory in a frame buffer 24. The graphics rendering section of the graphics subsystem is implemented in the address generator 18 and a set of data processors 26. These logic elements translate addresses received from the host CPU 4 into pixel data addresses and manipulate pixel data. The address generator 18 and the data processors 26 make up a pixel drawing engine 40. Video bus transceivers (XCVRs) 19 perform a read/write function to accommodate the additional load on the VI Bus 14 by the data processors 26 and the timing generator 38.

As used herein, the term graphics display is understood to refer to the process of outputting the pixel data from the frame buffer 24 to a viewing surface, preferably the monitor 8. The pixel data may be provided directly to a video graphics datapath logic section without the use of the frame buffer 24 so long as a sequential source of pixel data at video data rates is provided.

Figure 3:
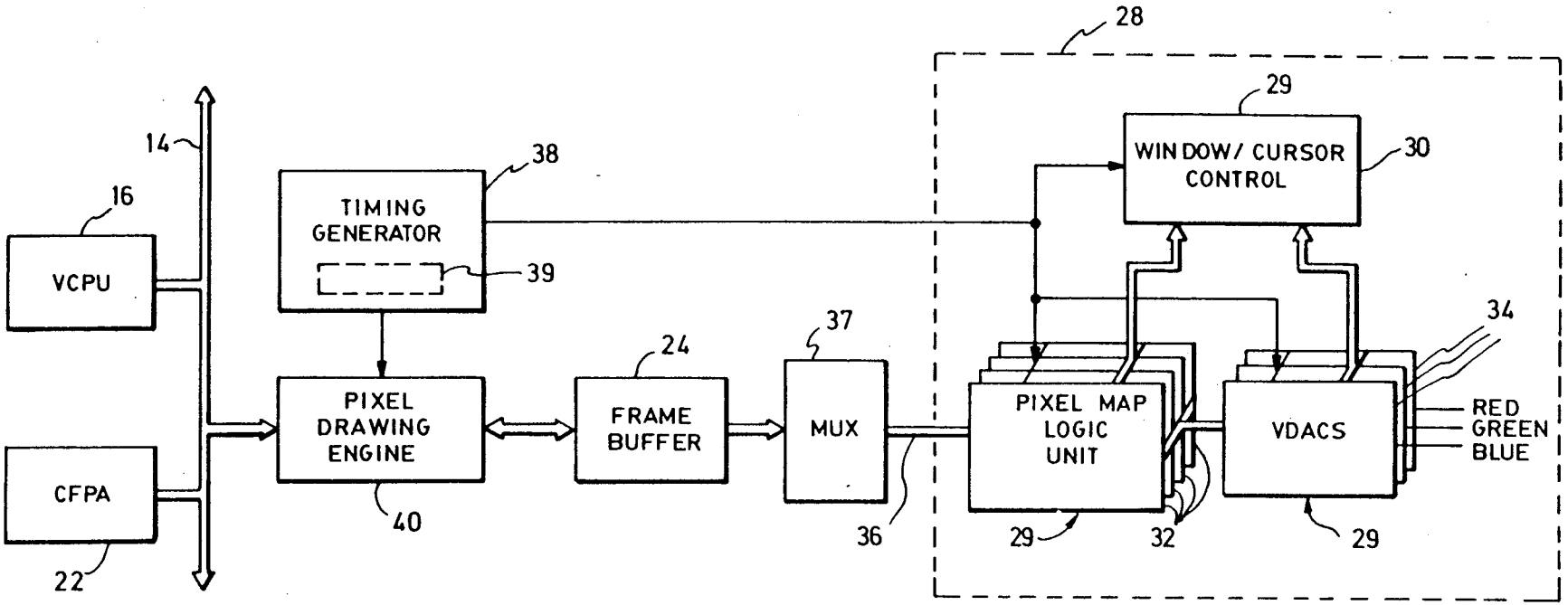
FIG. 3 is a block diagram of a video graphics subsystem employing the present invention.

The video graphics datapath logic section 28 of the graphics subsystem of FIG. 2 is provided. Referring to FIG. 3, the logic section 28 comprises a window/cursor control 30, a set of pixel map logic units 32 and a set of digital to analog converters (VDACs) 34. Collectively, the window/cursor control 30, the pixel map logic units 32 and the VDACs 34 may be referred to hereinafter as the video graphics or data path logic units 29. In a preferred embodiment, one window/cursor control 30, four pixel map logic units and three VDACs 34 are provided and each of these data path logic units is implemented on a single integrated circuit chip. The video graphics data path logic section 28 defines the windows on the screen and determines the source within the frame buffer 24 which will provide the pixel data for the current window. The video graphics data path logic section 28 also converts the digital information in the video graphics subsystem to an analog form to be displayed on monitor 8. This data includes bit map memory, overlay plane or cursor, as described more fully with relation to FIGS. 4–6.

FIG. 3 depicts a preferred embodiment of the present invention for loading data into data path logic unit registers (state tables) in the video data path logic section 28. These data are stored in so called off-screen scanlines of the frame buffer 24 and are loaded automatically into the window/cursor controls 30, the pixel map logic units 32 and the VDACs 34 by the screen refresh process starting after the last displayable scan. Data for the data path logic units 29 are sequentially loaded through four bit inputs 36 starting with the least significant bit ("LSB") of the first data path logic unit register ("register <0>") in the data path proceeding through the most significant bit ("MSB") of the last register of the last data path logic unit 29. A single four bit input 36 is used to load data into the state tables of each logic unit. Each input 36 is four bits wide so that data can be transferred and processed at one quarter of the full pixel rate. There are also as many inputs 36, each four bits wide, as there are bits in a pixel; for example, if 24 bits define a pixel, there will be 24 such inputs 36. There may also be additional inputs 36 to accommodate cursor data and overlay plane data as described below. A multiplexer 37 takes the data in the frame buffer 24 and feeds this data to the data path logic units 29 serially. Logic (not shown) generates the sequential addresses for the various registers in the data path logic units 29 in a manner known in the art.

A timing generator 38 is provided to control the loading and output of display data in on-screen memory of frame buffer 24, the loading of data in off-screen memory for the video output logic section 28 and the generation of timing signals for the monitor 8. Off-screen memory of the frame buffer 24 includes a copy of the data in the state tables of the data path logic units 29. The timing signals for the monitor 8 include conventional horizontal and vertical synchronization (sync) and blank signals.

The timing generator 38 includes a semaphore register 39. A semaphore is a control device to which atomic access is provided. Atomic access means that the control device can be read and modified by one process without any other process being able to read or modify it until the first process is complete and the semaphore is relinquished. Preferably the semaphore is implemented employing the data/state of the register 39. The semaphore is employed to arbitrate between two processes: the process of writing into or updating the frame buffer shadow copy of the state table data in the datapath logic units 29 and the process of reading the shadow copy.

Figure 4:
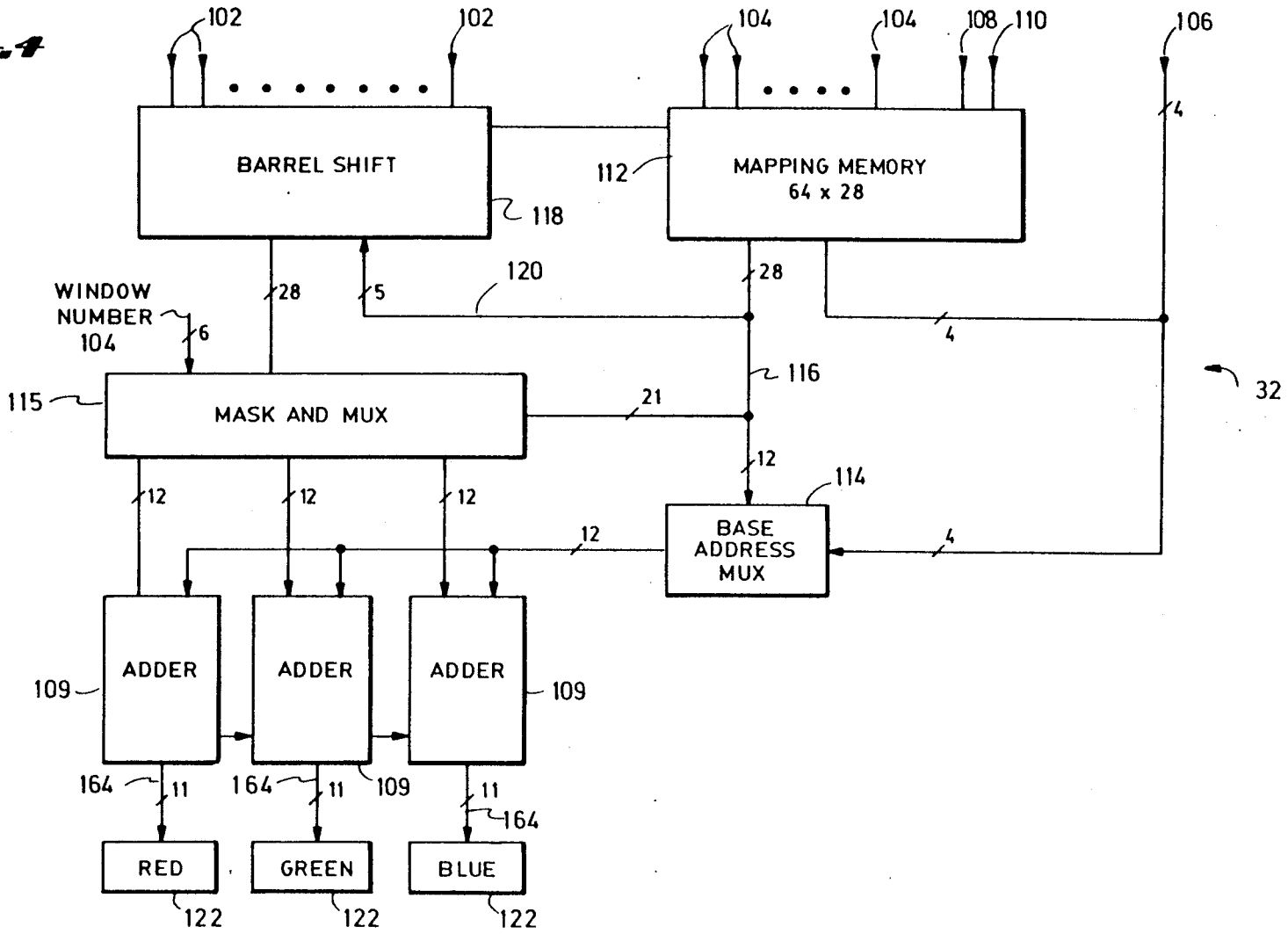
FIG. 4 is a block diagram of a pixel map logic unit which is employed to carry out the present invention.
Figure 5:
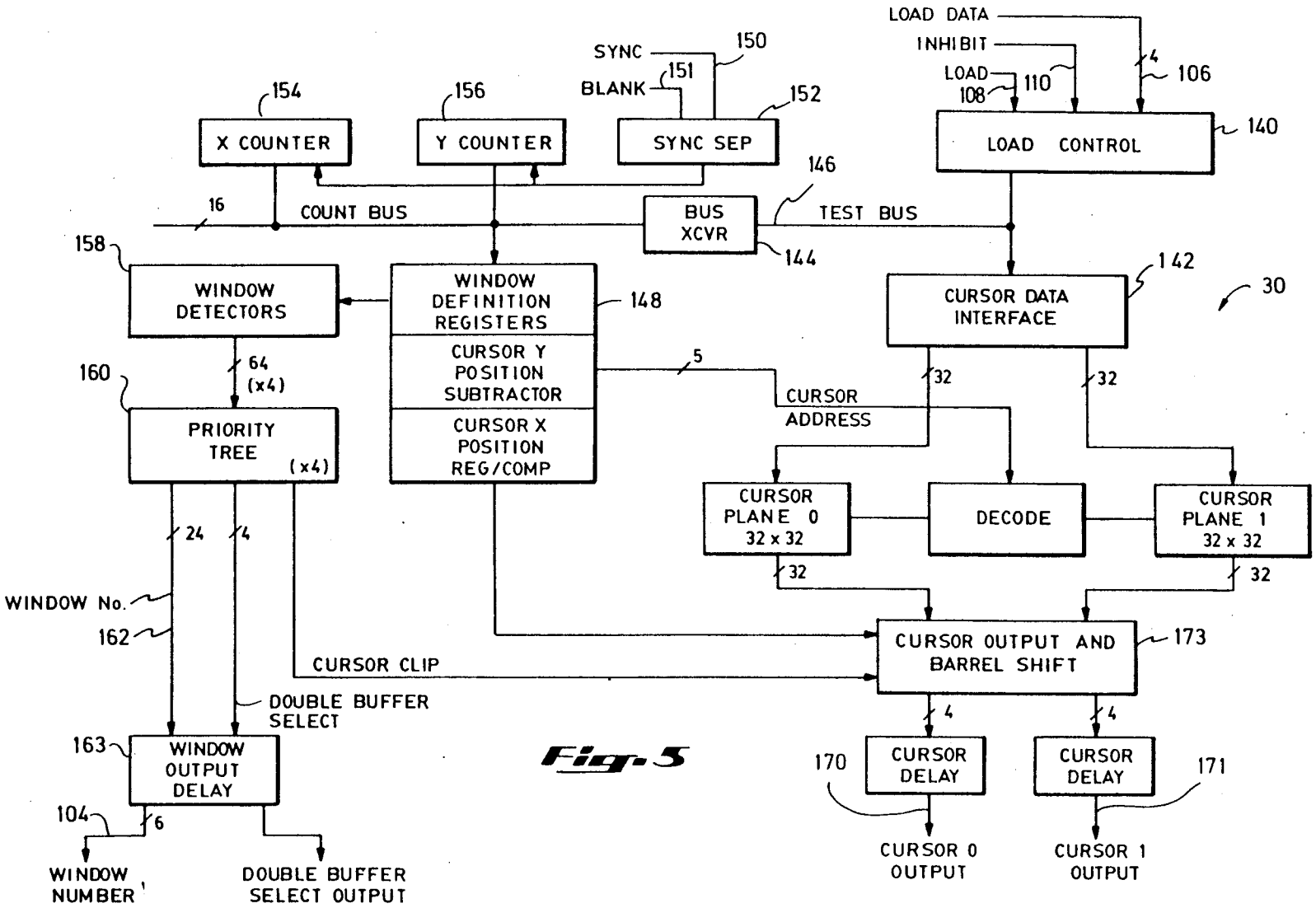
FIG. 5 is a block diagram of a window/curser control which is employed to carry out the present invention.
Figure 6:
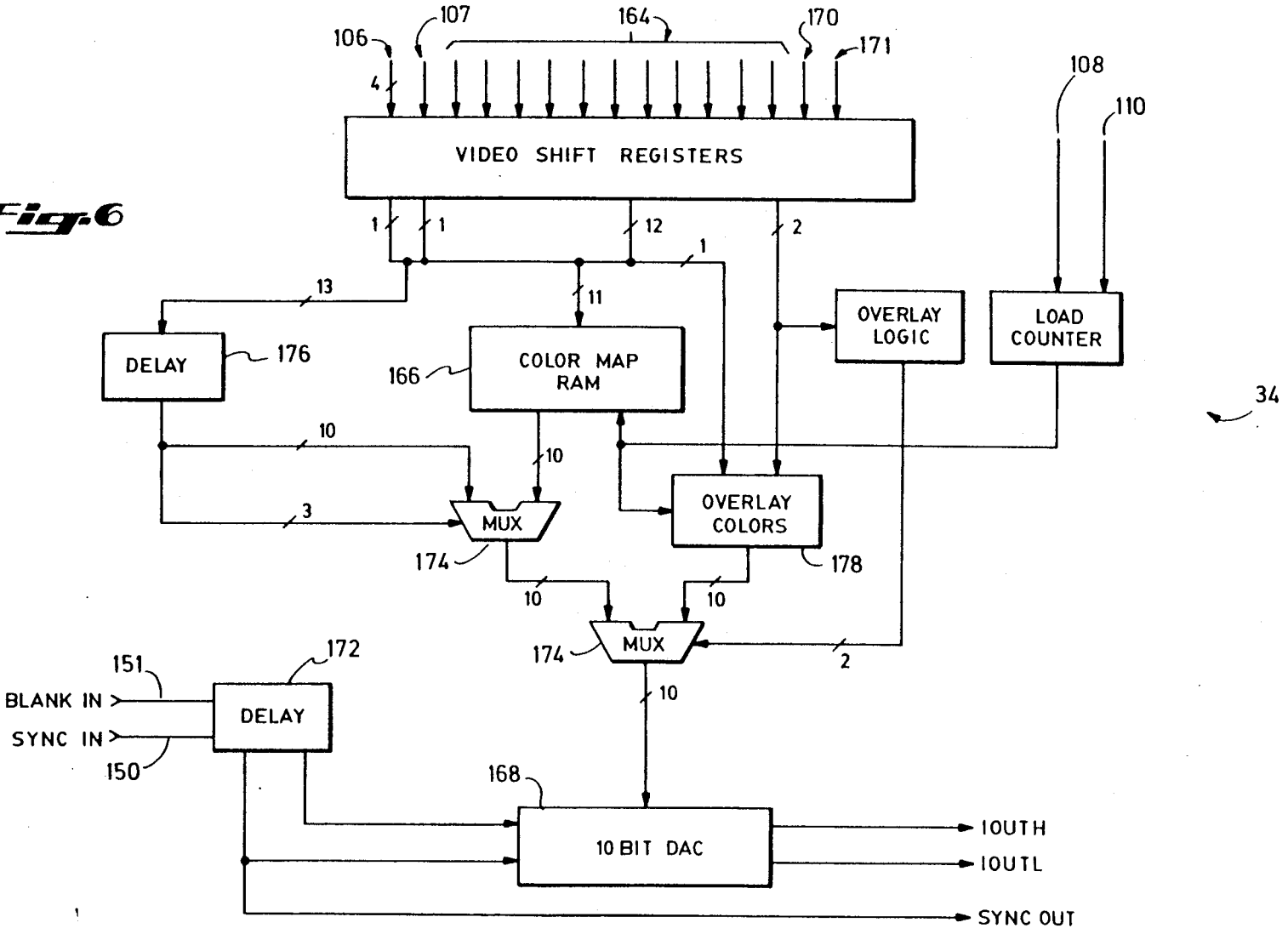
FIG. 6 is a block diagram of a video digital to analog converter which is employed to carry out the present invention.

The system timing generator 38 generates a LOAD signal 108 and an INHIBIT signal 110, shown in FIGS. 4, 5 and 6, and has an interface to the VCPU 16. Before the LOAD signal 108 is asserted, the timing generator 38 checks the semaphore register 39. If the VCPU 16 has the semaphore (i.e., update of the data path state table data in the frame buffer 24 is in progress), the INHIBIT signal 110 is asserted with the LOAD signal 108, thus preventing the reading of the off-screen memory of frame buffer 24 into the data path state tables during that vertical retrace. The INHIBIT signal 110 remains asserted for the entire interval during which the VCPU updates the copy of the state tables in offscreen memory of frame buffer 24. The data path logic units keep their previous state table values, which were valid. Since the data path logic units continue to use a set of valid values, a screen glitch is prevented.

If the VCPU 16 does not have the semaphore when the timing generator 38 is ready to assert the LOAD signal 108, then the timing generator 38 claims it and keeps it until vertical retrace is over. The VCPU 16 must then wait until the reading of the off-screen memory of frame buffer 24 into the data path logic units 29 is complete before it begins modifying the offscreen memory of frame buffer 24.

Referring now to FIGS. 4, 5 and 6, a preferred embodiment of the present invention is illustrated. Bit sizes of the various buses, shown in the conventional manner, are exemplary only, and are not by way of limitation. It is to be understood that FIGS. 4, 5 and 6 illustrate the primary flow paths of data and are not intended to illustrate all control lines. For example, for proper operation, the various circuit components are presumed to be provided with a proper clock signal in a conventional manner.

FIG. 4 illustrates a preferred embodiment of the pixel map logic unit 32. Pixel data from the onscreen memory of frame buffer 24 via multiplexer 37 is input to the pixel map logic unit via a set of data input lines 102. The data input lines 102 carry sufficient bits to define a pixel, in a preferred embodiment 24 bits. Additional data input lines 102 may be provided to accommodate overlay planes. The number of bits in the data input lines 102 equals the number of planes in the frame buffer 24. In a preferred embodiment, a 24 plane frame buffer provides 24 bits per pixel.

The pixel map logic unit 32 is provided with a window number input 104. The window number input 104 carries sufficient bits to select one of a plurality of windows, such as for example, 64 windows. The window number input 104 provides a window number from the window/cursor control 30 for each pixel input to data input lines 102. An embodiment of a window/cursor control 30 is shown in FIG. 5 and described below. The LOAD input 108 and the INHIBIT input 110 are provided to control the loading of data into the various registers in the pixel map logic unit 32. A load data input 106 provides the data from the off-screen memory of the frame buffer 24 via the multiplexer 37 to be loaded into the various registers under the control of the LOAD input 108 and the INHIBIT input 110.

On each clock pulse, a pixel value at the pixel data input lines 102 and a window number at the window number inputs 104 are input into the pixel map logic unit 32. The mapping select inputs 104 determine how the pixel values at the pixel input lines 102 are arranged to form a set of three 11 bit index values 164. The mapping information is stored in a mapping memory 112, one of the pixel map logic unit's state tables, which is addressed by the window number input 104.

As understood from FIG. 4, the load data input 106 loads the mapping memory 112. In a preferred embodiment, the mapping memory 112 contains register space for 64 words, mapping configuration words, one mapping configuration word for each possible window. The mapping configuration words and their use in a preferred embodiment are explained more fully below.

In loading the mapping memory 112, the load data input 106 provides a base value corresponding to each window, which is applied to a base address multiplexer 114 for each pixel. The pixel map logic unit 32 processes pixel data from the frame buffer 24 according to a specified pixel data type for each window. The processed pixel value produced in the pixel map logic unit 32 is then converted into an index into a physical colormap in the VDACs 34. These index values are indicated in FIG. 4 as set of index values 164 and are input into the VDACs 34 as shown in FIG. 6. This conversion is accomplished by adding a base value from the mapping memory 112 to the pixel value. The base value is selected based on the window containing this pixel. The pixel value is therefore a relative index into a window's virtual colormap, which is pointed to by the base value.

One example of the mapping configuration word is as follows:

| 27 | 26 | 25 | 24 | 20 | 19 | 16 | 15 | 12 | 11 | 0 | |
|---|---|---|---|---|---|---|---|---|---|---|---|
| V | Mod | | Shift | | Mask | | #Planes | | Base Value | | bit field |

The mapping configuration word is broken into fields as shown to control the various sections of the pixel map logic unit 32. One of the mapping configuration words is output from the mapping memory 112 onto the mapping configuration word bus 116. The "shift" field, as shown in the above example, carries, for example, 5 bits which are input into a barrel shift 118 via a shift bus 120. The barrel shift 118 shifts each input pixel value by a number of bits equal to the digital value on the shift bus 120. The barrel shift 118 then provides the shifted pixel value to a mask unit 115 which provides the inputs to a set of adders 109. In the adders 109, the base value from the base address MUX (for the window containing that pixel) is added to the digital value from the mask unit 115. The adders 109 thus develope the index values 164 which index color values in color lookup tables 122, shown in FIG. 6 as a colormap RAM 166. In a preferred embodiment, there are three adders 109 for producing indices into three physical color lookup tables according to red, green and blue colors to be displayed on the monitor. Thus, the present invention provides a means for modifying each pixel value according to the window number of the window containing the pixel to produce an index into a physical color lookup table, where the window number selects a virtual color lookup table within the physical color lookup table and the pixel value selects the color value within the virtual color lookup table.

Referring now to FIG. 5, the window/cursor control 30 which may be employed in carrying out the present invention is shown. The window/cursor control 30 provides two basic functions, hardware window support and hardware cursor support.

As with the pixel map logic unit 32, the window/cursor control 30 is responsive to the LOAD input 108 and the INHIBIT input 110. When the VCPU 16 captures the semaphore as stored in the register 39 in the timing generator 38, the LOAD input 108 goes to a high state enabling update of the state tables 9 of the Window/-Cursor control 30. This LOAD signal is triggered by the video graphics subsystem's vertical sync so that update occurs only during vertical retrace. If more data must be loaded into the state tables 9 of the Window/-Cursor Control 30 than can be loaded in one vertical retrace, then, just before the vertical retrace is complete, the INHIBIT input goes to a high state pausing the loading of the state tables.

Also as with the Pixel Map Logic Unit 32, data is loaded into the Window/Cursor Control 30 by way of the LOAD DATA input 106. The LOAD DATA input 106 inputs data into a LOAD Control 140 which either enables or disables the loading of data as indicated by the value in the semaphore register 39. If the semaphore indicates that data is to be loaded, the data is sent to a Cursor Data Interface 142 or to a Bus Transceiver (XCVR) 144 as dictated by the internal logic of the Window/Cursor Control 30 in a manner known in the art. A Test Bus 146 is provided, and it is a bidirectional bus. The Bus transceiver 144 permits data to be sent from the Test Bus 146 to a set of Window Definition Registers 148 or to permit the data from the Window Definition Registers 148 to be written onto the Test Bus 146.

A Sync input 150 provides a composite signal which includes information about the horizontal and vertical sync signals of the video graphics subsystem 6. A Sync separator (Sync Sep) 152 is provided to separate the vertical and horizontal sync signals to provide clock signals to an X counter 154 and to a Y counter 156. Thus, the window/cursor control 30 calculates the position of the CRT refresh logic for the monitor 8 via a set of internal X and Y counters. By using the monitor's sync signal via the sync input 150 and the monitor's blank signal via blank input 151, the window/cursor control 30 is able to keep these counters synchronous with the refresh and retrace cycles of the monitor 8. At all times, the values of the X Counter 154 and the Y Counter 156 correspond with the actual refresh process on the CRT 8. On every clock cycle, these counter values are compared with the programmed cursor position and all of the window definition registers 148. In this way, a window number is output to the pixel map logic units 32 for each pixel. The origin is in the upper left, with increasing X values to the right and increasing Y values downward.

The window/cursor control 30 has two primary sections, a cursor section which comprises the cursor data interface 142 (and the elements that it communicates with) and a window section which comprises the Bus XCVR 144 (and the elements that it communicates with). The window section computes three sets of outputs. The first is the window number which for each pixel, is sent to the pixel map logic units 32. Next, the window/cursor control 30 computes a double buffer select signal which is used to select one of two banks of RAM chips to enable double buffering on a per window basis. The final value that the window/cursor control 30 computes is used internally as clipping information for the cursor and is used to allow the cursor to appear in selected windows. This feature may be used when displaying a hairline cursor in a window. This signal will clip the cursor allowing it to appear only in unoccluded portions of selected windows.

The cursor section computes two values, a cursor 0 output 170 and a cursor 1 output 171. These values are input to VDACs 34 as an index into the hardware colormap as described with regard to FIG. 6. The cursor section produces a sprite cursor in a manner known in the art.

The window definition registers 148 send window definitions to a set of window detectors 158. If two or more windows overlap, then the overlap will encompass pixels within both windows. The window detectors 158 in turn provide window descriptions to a priority tree 160. The priority tree 160 determines, of those windows defined, which are the highest priority for each pixel. In other words, if window A and window B overlap and window A covers up part of window B, window A has the higher priority and will be assigned on a window no. output 162. If a particular pixel is not contained in any window, default window mapping is output as a background.

Referring to FIG. 6, one example of the VDAC 34 which employs the present invention is shown. One such VDAC 34 is provided for each of the red, green and blue channels of the monitor 8. The VDAC 34 includes the LOAD input 108 and the INHIBIT input 110. When the various registers of the VDAC 34 are to be updated, the VCPU 16 verifies that the semaphore is available (the CRT 8 is not in active video refresh) and captures it. At the beginning of vertical retrace, the LOAD input 108 goes to a high state enabling the loading of the VDAC 34 registers. At that point, the VDAC 34 registers are updated through the load data input 106. If more data must be loaded into the registers than can be loaded during one vertical retrace, the INHIBIT input 110 goes to a high state, thus pausing register update. At the end of the active video refresh, the INHIBIT input 110 again goes to a low state and the loading of the registers continues to completion.

The pixel map logic units 32 provide the set of index values 164 for each of the red, green and blue channels of the VDAC 34. Each of the index values 164 is four bits wide (one bit from each of the four pixel map logic units 32). Since each index value 164 indexes a location into a color map RAM 166, each window can use a different portion of the color map RAM 166, and each window is provided with full color independently of other windows. Similarly, cursor 0 input 170 and cursor 1 input each indexes its own location into a color map in an overlay colors register 178 to provide for a three colored cursor that can therefore be seen against any color of background or window. Each bit is then routed via a set of multiplexers 174 to a DAC 168 where it is converted to an analog value which drives either the red, green or blue channel of the monitor. The blank signal via blank input 151 and sync signal via sync input 150 are input to adjustable delay 172 to compensate for other delays in the video graphics subsystem. The mapping scheme as herein described can be optionally disabled by map enable input 107. Asserting map enable input 107 bypasses color map RAM 166 through delay 176 which provides sufficient delay to match that of color map RAM 166. In a preferred embodiment, the DAC 168 is capable of driving a one volt ground referenced RS343 compatible video into a 75 ohm cable.

Cursor 0 input 170 and cursor 1 input 171 are used to select pixel by pixel between video data or three overlay colors. When both cursor 0 input 170 and cursor 1 input 171 are zero, the video data is selected. The three other input states select one of three overlay color registers in the overlay colors register 178. The overlay colors register 178 is updated by data from the load data input 106 under the control of the LOAD input 108 and the INHIBIT input 110 in accordance with the present invention. Thus, a cursor may have colors different from all the colors in the colormap RAM 166.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A computer video graphics system for displaying pixel values in one or more windows on a monitor, comprising:

a. a physical color lookup table for storing one or more virtual color lookup tables for producing digital color values to be displayed on the monitor;

b. a pixel value memory containing pixel values for indexing into one or more virtual color lookup tables;

c. means for providing a window number corresponding to each pixel value in the pixel value memory;

d. a base value lookup table having a base value for each window, said base value lookup table having means for allowing access to said base value lookup table by using said window numbers as indices into said base value lookup table; and e. adders for adding pixel values to the base value from the base value lookup table thereby to produce indices into the physical color lookup table.

2. The graphics system according to claim 1 and including a monitor for displaying color values indexed from the physical color lookup table.

3. The graphics system according to claim 1 wherein said base value lookup table is included in a mapping memory.

4. The graphics system according to claim 2 wherein there are three of said adders for producing indices into three physical color lookup tables according to red, green and blue colors to be displayed on the monitor.

5. A computer video graphics system for displaying pixel values in one or more windows on a monitor, comprising:

a. a physical color lookup table for storing one or more virtual color lookup tables for producing digital color values to be displayed on the monitor;

b. a sequential source of pixel data provided at a video data rate for indexing into one or more virtual color lookup tables;

c. means for providing a window number corresponding to each pixel value indexed into the virtual color lookup tables; and d. means for modifying the pixel value according to said window number to produce an index into the physical color lookup table, where the window number selects a virtual color lookup table within the physical color lookup table and the pixel value selects the color value within the virtual color lookup table.

6. The graphics system of claim 5 wherein the virtual color lookup tables within the physical color lookup table can be of different sizes.

7. In a computer video graphics system having a physical color lookup table with a plurality of virtual color lookup tables allocated within the physical color lookup table for providing color values to be displayed on a monitor and having a source of pixel values to be displayed in windows on the monitor, a method of allocating physical color lookup table space among a plurality of windows, comprising the steps of:

a. providing a window number for each said pixel value;

b. obtaining a pixel value from the pixel source; and c. modifying the pixel value according to said window number to produce an index into the physical color lookup table where the window number selects a virtual color lookup table within the physical color lookup table and the pixel value selects the color value within the virtual color lookup table.

8. The method of claim 7, further comprising the step of changing the allocation of the virtual color lookup table without changing the pixel values provided from the pixel value source.

9. In a computer video graphics system having a physical color lookup table for providing color values to be displayed on a monitor, and further having a source of pixel values to be displayed in windows on the monitor, the method of indexing the physical color lookup table comprising the steps of:

a. providing respective window numbers for each said pixel value;

b. providing a base value corresponding to each window number;

c. selecting the base value corresponding to the window number associated with the pixel value;

d. adding the base value to said pixel value to produce a modified pixel value; and e. indexing the physical lookup table according to the modified pixel value to produce said digital color values to be displayed on the monitor.

10. The method of indexing according to claim 9 and further including the step of transferring said pixel value from the source of pixel values.

11. The method of indexing according to claim 9 further including the step of changing the base value corresponding to a window number wherein changing that base value changes the indices into the physical color lookup table without changing the pixel value from the pixel source.

* * * * *

UNITED STATES PATENT AND TRADEMARK OFFICE

CERTIFICATE OF CORRECTION

PATENT NO. : 5,025,249

DATED : Jun 18, 1991

INVENTOR(S) : Larry Dean Seiler et al.

It is certified that error appears in the above-identified patent and that said Letters Patent is hereby corrected as shown below:

In column 1 line 23, after the word "field" insert the words -- of computer --.

Signed and Sealed this

Sixth Day of October, 1992

*Attest:*

DOUGLAS B. COMER

*Attesting Officer*

*Acting Commissioner of Patents and Trademarks*